US009784106B2

(12) United States Patent
Luo et al.

(10) Patent No.: US 9,784,106 B2
(45) Date of Patent: Oct. 10, 2017

(54) MULTI-STAGE DOUBLE-ACTING TRAVELING-WAVE THERMOACOUSTIC SYSTEM

(71) Applicant: LIHAN THERMOACOUSTIC TECHNOLOGIES (SHEN_ZHEN) CO., LTD., Shenzhen (CN)

(72) Inventors: Ercang Luo, Shenzhen (CN); Jianying Hu, Shenzhen (CN); Wei Dai, Shenzhen (CN); Zhanghua Wu, Shenzhen (CN); Guoyao Yu, Shenzhen (CN); Haibing Li, Shenzhen (CN)

(73) Assignee: Lihan Thermoacoustic Technologies (Shen Zhen) Co., Ltd., Guangdong (CN)

( * ) Notice: Subject to any disclaimer, the term of this patent is extended or adjusted under 35 U.S.C. 154(b) by 791 days.

(21) Appl. No.: 14/214,153

(22) Filed: Mar. 14, 2014

(65) Prior Publication Data

US 2014/0196452 A1 Jul. 17, 2014

Related U.S. Application Data

(63) Continuation of application No. PCT/CN2012/073374, filed on Mar. 31, 2012.

(30) Foreign Application Priority Data

Apr. 1, 2011 (CN) ..... 2011 1 0082262
Apr. 22, 2011 (CN) ..... 2011 1 0101963

(51) Int. Cl.
*F01B 29/08* (2006.01)
*F25B 9/10* (2006.01)
*F25B 9/14* (2006.01)

(52) U.S. Cl.
CPC ..... *F01B 29/08* (2013.01); *F25B 9/10* (2013.01); *F25B 9/145* (2013.01); *F25B 2309/1408* (2013.01); *F25B 2400/073* (2013.01)

(58) Field of Classification Search
CPC .. F01B 29/08; F25B 9/10; F25B 9/145; F25B 2309/1408; F25B 2400/073;
(Continued)

(56) References Cited

U.S. PATENT DOCUMENTS 5,269,147 A * 12/1993 Ishizaki ..... F25B 9/14 62/467
6,604,364 B1 * 8/2003 Arman ..... F01K 25/065 60/520
2008/0110180 A1 5/2008 Watanabe et al. ..... 62/6

FOREIGN PATENT DOCUMENTS

CN 100366991 C 2/2008
CN 100545449 C 9/2009
CN 101706169 A 5/2010

OTHER PUBLICATIONS

International Search Report of corresponding International Application No. PCT/CN2012/073374, dated Jun. 14, 2012.
(Continued)

*Primary Examiner* — Mark Laurenzi
*Assistant Examiner* — Mickey France
(74) *Attorney, Agent, or Firm* — J.C. Patents

(57) ABSTRACT

The present invention provides a multi-stage double-acting traveling-wave thermoacoustic system, comprising three elementary units, each elementary unit comprises a linear motor and a thermoacoustic conversion device; the linear motor comprises a piston and a cylinder, the piston can perform a straight reciprocating motion in the cylinder; each thermoacoustic conversion device comprises a main heat exchanger and a heat regenerator connected in sequence, and
(Continued)

the heat regenerator is of a ladder structure; a set of a non-normal-temperature heat exchanger, a thermal buffer tube and an auxiliary heat exchanger is connected at each ladder of the heat regenerator; and the main heat exchanger and the auxiliary heat exchanger of each thermoacoustic conversion device are connected to cylinder cavities of different linear motors respectively forming a loop structure for flow of a gas medium. The multi-stage double-acting traveling-wave thermoacoustic system can improve the working performance of the multi-stage double-acting traveling-wave thermoacoustic system.

14 Claims, 3 Drawing Sheets

(58) Field of Classification Search
CPC ..... F25B 2309/001; F25B 2309/14; F25B 2309/1412; F25B 2309/1415; F25B 2309/1416
USPC ..... 60/516, 525, 526; 62/6, 467
See application file for complete search history.

(56) References Cited

OTHER PUBLICATIONS

Chinese First Examination Report of China Application No. 201110101963.7, dated Aug. 5, 2013.

* cited by examiner

MULTI-STAGE DOUBLE-ACTING TRAVELING-WAVE THERMOACOUSTIC SYSTEM

CROSS-REFERENCE TO RELATED APPLICATIONS

This application is a continuation of International Patent Application No. PCT/CN2012/073374, filed on Mar. 31, 2012, which claims priority to Chinese Patent Applications No. 201110082262.3 and No. 201110101963.7, filed on Apr. 1, 2011, and Apr. 22, 2011 respectively, the contents of all the above mentioned applications are hereby incorporated by reference in their entireties.

FIELD OF THE TECHNOLOGY

The present invention relates to energy power and low-temperature cooling technology, in particular, to a multi-stage double-acting traveling-wave thermoacoustic system.

BACKGROUND

When propagating in a gas, acoustic waves will generate fluctuations of pressure, displacement, and temperature in the propagation medium gas. When interacting with a fixed boundary, the gas can induce conversion between acoustic energy and heat energy, which is called thermoacoustic effect.

A thermoacoustic system is an energy conversion system designed using the thermoacoustic effect principle, which may convert heat energy into acoustic energy, or convert acoustic energy into heat energy. A thermoacoustic system can be divided into two kinds: thermoacoustic engines and thermoacoustic refrigerators, where thermoacoustic engines include traveling-wave thermoacoustic engines and Stirling engines, and thermoacoustic refrigerators include traveling-wave thermoacoustic refrigerators, pulse tube refrigerators and Stirling refrigerators.

In the above thermoacoustic systems, traveling-wave thermoacoustic engines and refrigerators use inert gas, such as helium or nitrogen, as working medium. They have advantages of high efficiency, safety and long service life, thus having attracted widespread public attention. Hitherto employing a thermoacoustic engine in power generation and employing a thermoacoustic refrigerator in low-temperature refrigeration have already been successful.

Refer to FIG. 1 which is a schematic view of an existing traveling-wave thermoacoustic refrigeration system.

As shown in FIG. 1, the traveling-wave thermoacoustic refrigeration system includes three elementary units, where each elementary unit includes a linear motor 1*a* and a thermoacoustic conversion device 2*a*.

The linear motor 1*a* includes a cylinder 11*a*, a piston 12*a*, a piston rod 13*a*, a motor housing 14*a*, a stator 15*a*, a mover 16*a*, and an Oxford spring 17*a*.

The stator 15*a* is fixedly connected to the inner wall of the motor housing 14*a*; the mover 16*a* and the stator 15*a* are of clearance fit; the piston rod 13*a* and the mover 16*a* are fixedly connected to each other; the piston rod 13*a* and the Oxford spring 17*a* are fixedly connected to each other; during the operation of the linear motor 1*a*, the mover 16*a*, via the piston rod 13*a*, drives the piston 12*a* to perform linear reciprocating motion within the cylinder 11*a*.

The thermoacoustic conversion device 2*a* includes a main heat exchanger 21*a*, a heat regenerator 22*a*, and a non-normal-temperature heat exchanger 23*a* connected in sequence. The main heat exchanger 21*a* is connected to a cylinder cavity of a linear motor 1*a*, i.e., a compression chamber 18*a*; the non-normal-temperature heat exchanger 23*a* is connected to a cylinder cavity of another linear motor 1*a*, i.e., an expansion chamber 19*a*. Thus, the thermoacoustic system constitutes a loop of medium flow.

When the traveling-wave thermoacoustic system works as a refrigerator, electrical power is supplied to the linear motor 1*a*. The mover 16*a* drives the piston 12*a* performing a linear reciprocating motion within the cylinder 11*a*, the gas medium volume within the compression chamber 18*a* changes, generating acoustic energy which enters into the main heat exchanger 21*a*, passes through the heat regenerator 22*a*, and most of the acoustic energy is consumed within the heat regenerator, producing refrigeration effect so as to lower the temperature of the non-normal-temperature heat exchanger. The remaining acoustic energy comes out from the non-normal-temperature heat exchanger 23*a*, being fed back to an expansion chamber 19*a* of another linear motor 1*a*, and then transferred to a piston 12*a* of the second linear motor 1*a*.

When the traveling-wave thermoacoustic system works as an engine, acoustic wave absorbs heat energy and converts it into acoustic energy inside the heat regenerator 22*a* and the non-normal-temperature heat exchanger 23*a*. The acoustic energy comes out from the non-normal-temperature heat exchanger 23*a* after being enlarged, enters into the expansion chamber 19*a* of the linear motor 1*a*, and drives the piston 12*a*. The acoustic energy is divided into two parts at the piston 12*a*, one part enters the compression chamber 18*a*, being fed back into another heat regenerator 22*a*, another part is converted into output power through the linear motor 1*a*.

During the course of study and development of the present invention, the inventors found the following technical defects of the existing traveling-wave thermoacoustic system: in the course of practical application, the non-normal-temperature heat exchanger 23*a* can only perform heat exchange within an extremely small temperature range. Therefore, while the traveling-wave thermoacoustic system is working as an engine, only the heat within an extremely small temperature range of the heat source supplying heat for the non-normal-temperature heat exchanger 23*a* can be used by the non-normal-temperature heat exchanger 23*a*. For example, the working temperature of the non-normal-temperature heat exchanger 23*a* ranges between 650° C. to 700° C., whereas the heat source and the non-normal-temperature heat exchanger 23*a* are exchanging heat, only within temperature range between 650° C. to 700° C., the heat can be absorbed. When the temperature of the heat source is below 650° C., the heat cannot be absorbed, thus inducing heat energy wastage and reducing conversion efficiency of the thermoacoustic energy.

In addition, while the traveling-wave thermoacoustic system is used as a refrigerator, the traveling-wave thermoacoustic system can only provide the refrigeration at one temperature, thus cannot obtain a lower refrigeration temperature. Therefore, it hampers the refrigeration performance of the traveling-wave thermoacoustic system.

SUMMARY

The present invention provides a multi-stage traveling-wave thermoacoustic system with double-acting, for solving the defects in the prior art, which can improve the conversion efficiency of the thermoacoustic energy, and improve working performance of the traveling-wave thermoacoustic system.

The present invention provides a multi-stage double-acting traveling-wave thermoacoustic system including three elementary units, wherein each elementary unit includes a linear motor and a thermoacoustic conversion device; the linear motor includes a piston and a cylinder, and the cylinder includes a cylinder cavity, wherein the piston can perform a straight reciprocating motion in the cylinder; each thermoacoustic conversion device includes a main heat exchanger and a heat regenerator connected in sequence, and the heat regenerator is of a ladder structure; wherein a set of a non-normal-temperature heat exchanger, a thermal buffer tube and an auxiliary heat exchanger is connected at each ladder of the heat regenerator; and the main heat exchanger and the auxiliary heat exchangers of each thermoacoustic conversion device are connected to cylinder cavities of different linear motors respectively, forming a loop structure for flow of a gas medium. The main heat exchanger and the auxiliary heat exchangers of each thermoacoustic conversion device are connected to cylinder cavities of different linear motors respectively, forming a loop structure for flow of a gas medium.

The thermoacoustic conversion device in the multi-stage double-acting traveling-wave thermoacoustic system according to the present invention includes a main heat exchanger and a heat regenerator connected in sequence, wherein the heat regenerator is of a ladder structure, and a non-normal-temperature heat exchanger, a thermal buffer tube and an auxiliary heat exchanger are respectively connected in sequence at each ladder of the heat regenerator.

Because the non-normal-temperature heat exchanger, thermal buffer tube and auxiliary heat exchanger are respectively connected in sequence at each ladder of the heat regenerator, the multi-stage double-acting traveling-wave thermoacoustic system according to the present invention can sufficiently exploit heat energy or provide refrigeration capacity in different temperature ranges, enhancing conversion efficiency of the heat energy, and improving the working performance of the multi-stage double-acting traveling-wave thermoacoustic system.

Figure 1:
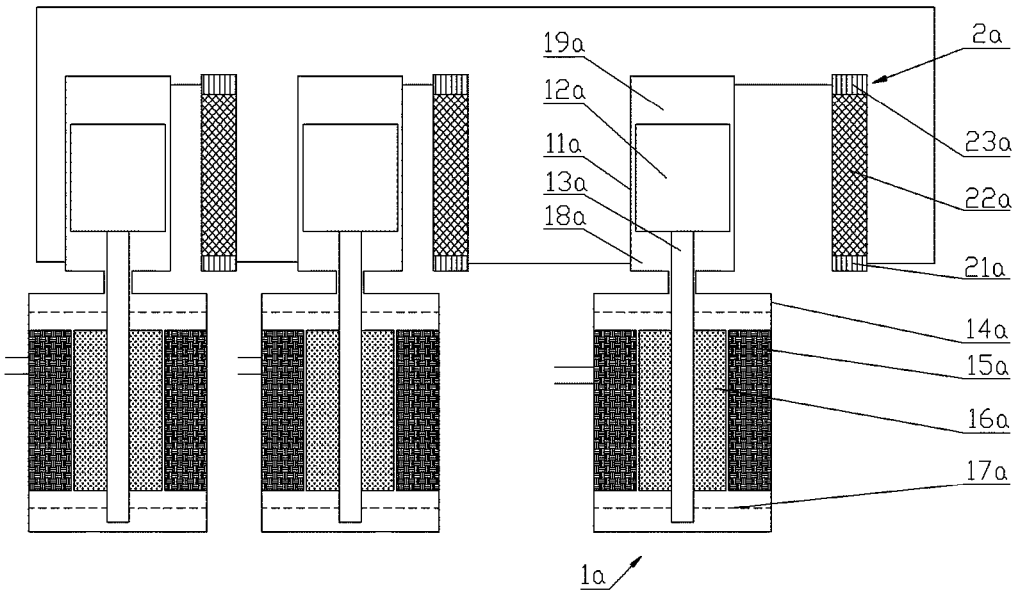
FIG.1 (PRIOR ART)
FIG. 1 is a schematic view of a conventional traveling-wave thermoacoustic system.

Reference signs:

| | | |
|---|---|---|
| 1. Linear motor | 11. Cylinder | 12. piston |
| 13. Piston rod | 14. Motor housing | 15. Stator |
| 16. Mover | 17. Oxford spring | 18. Compression chamber |
| 191. First expansion chamber | 192. Second expansion chamber | 193. Third expansion chamber |
| 2. Thermoacoustic conversion device | 21. Main heat exchanger | 22. Heat regenerator |
| 231. First non-normal-temperature heat exchanger | | |
| 232. Second non-normal-temperature heat exchanger | | |
| 233. Third non-normal-temperature heat exchanger | | |
| 241. First thermal buffer tube | 242. Second thermal buffer tube | 243 Third thermal buffer tube |
| 251. First auxiliary heat exchanger | 252. Second auxiliary heat exchanger | |
| 253. Third auxiliary heat exchanger | 31. First DC suppressor | 32. Second DC suppressor |

DETAILED DESCRIPTION

The present invention provides a multi-stage double-acting traveling-wave thermoacoustic system, including at least three elementary units. Each elementary unit includes a linear motor and a thermoacoustic conversion device; the linear motor includes a piston and a cylinder, and the cylinder includes a cylinder cavity, where the piston can perform a straight reciprocating motion in the cylinder; the thermoacoustic conversion device includes a main heat exchanger and a heat regenerator connected in sequence, and the heat regenerator is of a ladder structure; a set of a non-normal-temperature heat exchanger, a thermal buffer tube and an auxiliary heat exchanger is connected at each ladder of the heat regenerator; and the main heat exchanger and the auxiliary heat exchanger of each thermoacoustic conversion device are connected to cylinder cavity of different linear motors, respectively, forming a loop structure for flow of a gas medium.

Because the non-normal-temperature heat exchanger, thermal buffer tube and auxiliary heat exchanger are respectively connected in sequence at each ladder of the heat regenerator, the multi-stage double-acting traveling-wave thermoacoustic system according to the present invention can sufficiently exploit heat energy or provide refrigeration capacity in different temperature ranges. As a result, the multi-stage double-acting traveling-wave thermoacoustic system can enhance conversion efficiency of the heat energy, and improve the working performance of the multi-stage double-acting traveling-wave thermoacoustic system.

There can be various design forms for the cylinder cavity of the linear motor depending on the relative positions. The designs of the heat regenerator in the thermoacoustic conversion device are diverse, and the connecting modes between the non-normal-temperature heat exchanger, the thermal buffer tube and the auxiliary heat exchanger and the cylinder cavity of the linear motor can vary, which are capable of forming multiple loop structures with different paths. For example:

The number of pistons can be one, and shapes of the cylinder and the piston are of mutually matched ladder structures, and a plurality of the cylinder cavities is respectively formed at each ladder of a ladder side of the piston.

Or, the number of pistons is one, and shapes of the cylinder and the piston are of mutually matched ladder structures, and a plurality of the cylinder cavities is respectively formed at each ladder of a ladder side of the piston and at a flat side of the piston. Namely, a cylinder cavity is formed at the flat side of the piston, whereas other cylinder cavities are formed at the ladder side of the piston.

The ladder structure of the piston is preferably a secondary ladder structure, a tertiary ladder structure, or a quaternary ladder structure, although it is not limited to the number, which can be determined by the number of the sets of the non-normal-temperature heat exchanger, the thermal buffer tube and the auxiliary heat exchanger.

The different loop structures formed by the connecting mode between the cylinder cavity and heat exchanger are related to the working phase of the gas medium. The working efficiency can be improved when the loop structure is cooperating with appropriate quantity of elementary units.

For example, the working surfaces of the piston in each cylinder cavity can be arranged as parallel, whereas there is one working surface is in opposite direction with other working surfaces. The cylinder cavity forming an opposite working surface is connected to the main heat exchanger, where the correspondent quantity of the elementary units is three or four.

Or, the working surfaces of the pistons in each cylinder cavity are parallel and in the same direction, where the correspondent quantity of the elementary units is four to twelve.

Based on the above technical solutions, one DC suppressor can be mounted on the connecting pipeline, preferably on the connecting pipeline of the main heat exchanger and the cylinder cavity, and/or on the connecting pipeline of the auxiliary heat exchanger and the cylinder cavity. DC loss caused by the gas medium in the loop structure can be avoided through the DC suppressor, so as to improve the conversion efficiency of high thermoacoustic energy of the multi-stage double-acting traveling-wave thermoacoustic system, and improve working performance. Preferably, the DC suppressor is a jet pump or an elastic diaphragm capsule.

Various embodiments can be obtained through combinations of the design factors such as the quantity and position of the cylinder cavity, the quantity of the loop structure and the elementary unit. In an attempt to enable the person skilled in the art to better understand the technical solutions of the present invention, further elaboration of the present invention will be set forth as follows in conjunction with figures and embodiments.

Figure 2:
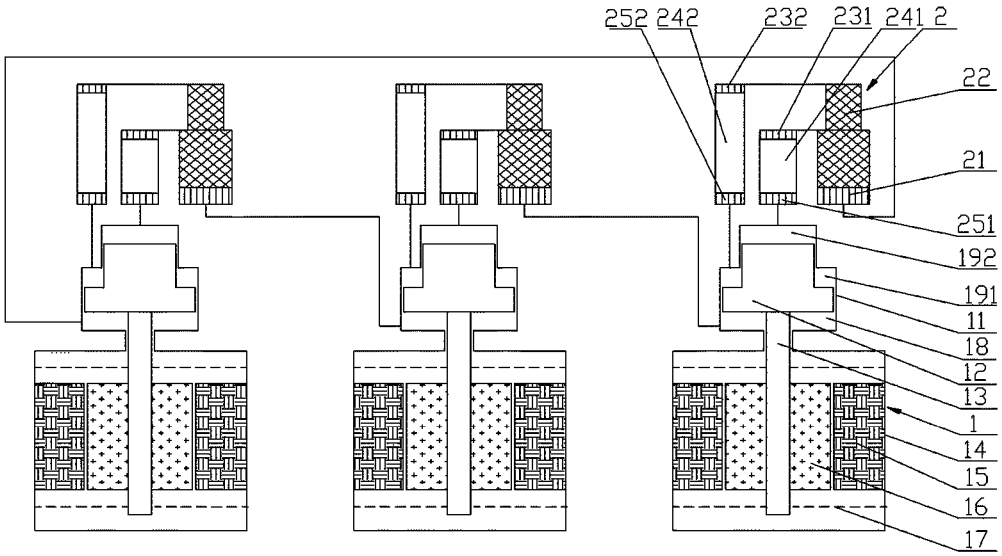
FIG. 2 is a schematic view of a multi-stage double-acting traveling-wave thermoacoustic system according to a first embodiment of the present invention.

Referring to FIG. 2, which is a schematic view of the multi-stage traveling-wave thermoacoustic system with double-acting provided in the first embodiment of the present invention.

In the first embodiment of the present invention, a multi-stage traveling-wave thermoacoustic system with double-acting includes three elementary units. In FIG. 2, only the reference signs of each component of the elementary unit at the right end of the figure are indicated. Because the components of other two elementary units are identical to that of this elementary unit, therefore, same components are not indicated in FIG. 2, in order to simplify the figure.

Each elementary unit includes a linear motor 1 and a thermoacoustic conversion device 2. In each elementary unit, a structure of a preferable linear motor 1 includes a cylinder 11, a piston 12, a piston rod 13, a motor housing 14, a stator 15, a mover 16 and an Oxford spring 17.

The piston 12 and the cylinder 11 are minimal clearance fitted with each other, and the fitting clearance may be 0.01-0.1 mm; the piston 12 can perform a straight reciprocating motion in the cylinder 11; the stator 15 is fixed on the inner wall of the motor housing 14; the mover 16 is fixed with the piston rod 13; the mover 16 is fitted with the stator 15; appropriate clearance is provided between the mover 16 and the stator 15; the piston rod 13 is minimal clearance fitted with the neck of the motor housing 14; the mover 16 may drive the piston 12 to perform a straight reciprocating motion in the cylinder 11.

According to the present embodiment, the thermoacoustic conversion device 2 includes a main heat exchanger 21, a heat regenerator 22, a first non-normal-temperature heat exchanger 231, a second non-normal-temperature heat exchanger 232, a first thermal buffer tube 241, a second thermal buffer tube 242, a first auxiliary heat exchanger 251, and a second auxiliary heat exchanger 252.

The heat regenerator 22 is of a secondary ladder structure, where the first ladder of the heat regenerator 22 is connected to the first non-normal-temperature heat exchanger 231, and the second ladder of the heat regenerator 22 is connected to the second non-normal-temperature heat exchanger 232.

The number of the piston 12 in the cylinder 11 is one. The working surfaces of the piston 12 are parallel with each other, where the working surfaces of the piston 12 described herein refer to the surfaces capable of interacting with the gas medium in the cylinder 11 directly when the piston 12 is moving. Shapes of the cylinder 11 and the piston 12 are of secondary ladder structures matching each other. The cavities of the cylinder 11 include a compression chamber 18, a first expansion chamber 191 and a second expansion chamber 192.

The compression chamber 18 is a sealed chamber formed by the flat side of the piston 12 and the cylinder 11. The compression chamber 18 of the cylinder 11 in an elementary unit is connected to the main heat exchanger 21 of the thermoacoustic conversion device 2 in another elementary unit.

The first expansion chamber 191 is a sealed chamber formed by the first ladder of the cylinder 11 and the piston 12. In each elementary unit, the first expansion chamber 191 is connected to the second auxiliary heat exchanger 252 of the thermoacoustic conversion device 2 in the same elementary unit, forming a loop structure for the flow of a gas medium.

The second expansion chamber 192 is a sealed chamber formed by the second ladder of the cylinder 11 and the piston 12. In each elementary unit, the second expansion chamber 192 is connected to the first auxiliary heat exchanger 251 of the thermoacoustic conversion device 2 in the same elementary unit, forming a loop structure for the flow of a gas medium.

Three linear motors 1 in the present embodiment are connected to the three-phase alternating current through delta connection; the phase difference of the current of the three linear motors 1 is 120 degrees. Therefore, the phase difference of volume flow of the gas medium between the compression chamber 18 connected to the main heat exchanger 21, the second auxiliary heat exchanger 252 of each thermoacoustic conversion device 2 and the first auxiliary heat exchanger 251, the first expansion chamber 191 and the second expansion chamber 192 is also 120 degrees.

The respective working process of the thermoacoustic conversion device according to the present embodiment when it acts as a thermoacoustic engine and a thermoacoustic refrigerator will be described respectively hereinafter:

It should be firstly noted that, when the phase difference of volume flow between two ends of the thermoacoustic conversion device 2 lies in the range of 90-150 degrees, the thermoacoustic conversion efficiency of the thermoacoustic conversion device 2 is higher.

When the thermoacoustic conversion device 2 is used as a thermoacoustic engine, the main heat exchanger 21, the first auxiliary heat exchanger 251 and the second auxiliary heat exchanger 252 are under the condition of room temperature; now heat the first non-normal-temperature heat exchanger 231 and the second non-normal-temperature heat exchanger 232 to a high temperature.

When the temperatures of first non-normal-temperature heat exchanger 231 and the second non-normal-temperature heat exchanger 232 reach a threshold, the acoustic power of the gas medium enters the thermoacoustic conversion device 2 from the compression chamber 18. First, the acoustic power enters into the main heat exchanger 21, and then enters into the heat regenerator 22, the first non-normal-temperature heat exchanger 231 and the second non-normal-temperature heat exchanger 232. Inside the heat regenerator 22, the first non-normal-temperature heat exchanger 231 and the second non-normal-temperature heat exchanger 232, heat absorbed by acoustic wave is converted into acoustic power (acoustic energy). Therefore, the acoustic power is enlarged. The acoustic power coming out from the first non-normal-temperature heat exchanger 231 enters into the second expansion chamber 192 of another linear motor 1 through the first thermal buffer tube 241 and the first auxiliary heat exchanger 251, where the acoustic power coming out from the second non-normal-temperature heat exchanger 232 enters into the first expansion chamber 191 of another linear motor 1 through the second thermal buffer tube 242 and the second auxiliary heat exchanger 252. Once the piston 12 has absorbed the acoustic power of the first expansion chamber 191 and the second expansion chamber 192, it divides the acoustic power into two parts, one part of which is fed back to the compression chamber 18 and enters another thermoacoustic conversion device 2, and the other part is converted into output power by the linear motor 1.

The phase difference of the current of the three linear motors 1 is 120 degrees; they can be switch-in to the three-phase AC power grid after an appropriate transformation. The whole process of power generating is very simple.

When the thermoacoustic conversion device 2 is a thermoacoustic refrigerator, the main heat exchanger 21, the first auxiliary heat exchanger 251, and the second auxiliary heat exchanger 252 are under the condition of the room temperature. Three-phase power inputs power to the three linear motors 1, driving the piston 12 performing reciprocating motion to convert the power into acoustic power. The acoustic power enters the thermoacoustic conversion device 2 from the compression chamber 18 of the cylinder 11. Most acoustic energy is consumed in the heat regenerator 22 and causes cooling effect at the same time, which makes the temperatures of the first non-normal-temperature heat exchanger 231 and the second non-normal-temperature heat exchanger 232 fall. The rest of the acoustic power passes through the first thermal buffer tube 241 and the first auxiliary heat exchanger 251, and enters the second expansion chamber 192 of another linear motor 1, meanwhile, a portion of the rest of the acoustic power enters into the first expansion chamber 191 of another linear motor 1 through the second thermal buffer 242 and the second auxiliary heat exchanger 252, and feeds back to the piston 12.

Using three-phase AC as input power can directly obtain an ideal phase difference between the pistons 12, which is convenient for practical use.

It can be seen from the above expression that, in the present embodiment, because the heat regenerator 22 is a secondary ladder structure, the first non-normal-temperature heat exchanger 231, the first thermal buffer tube 241, and the first auxiliary heat exchanger 251 are connected in sequence at the first ladder of the heat regenerator 22, and the second non-normal-temperature heat exchanger 232, the second thermal buffer tube 242 and the second auxiliary heat exchanger 252 are connected in sequence at the second ladder of the heat regenerator 22. In addition, the cylinder 11 has a compression chamber 18, a first expansion chamber 191, and a second expansion chamber 192, where each elementary unit has two complete feedback loops. Thus, the multi-stage double-acting traveling-wave thermoacoustic system can sufficiently exploit heat energy or provide refrigeration capacity in two different temperature ranges, enhancing conversion efficiency of the heat energy, and improving the working performance of the multi-stage double-acting traveling-wave thermoacoustic system.

It should be noted that, as the number of the elementary units is three, the preferable mode is to guarantee one working surface of the piston 12 is in opposite direction of other working surfaces. According to the present embodiment, the working surface inside the compression chamber 18 is in opposite direction of the working surfaces of the first expansion chamber 191 and the second expansion chamber 192. Namely, in each linear motor 1, the preferable mode is to guarantee that when the compression chamber 18 is under a compression condition, the first expansion chamber 191 and the second expansion chamber 192 are under expansion conditions. If the compression chamber 18 is under a compression condition, and the first expansion chamber 191 and/or the second expansion chamber 192 are also under compression conditions, the phase difference of the volume flow at both ends of the thermoacoustic conversion device 2 will be less than 90 degrees, further it will result in the thermoacoustic conversion efficiency of the thermoacoustic conversion device 2 lowering.

In addition, there can be four elementary units in the present embodiment; higher conversion efficiency of the thermoacoustic energy can also be obtained using the above loop structure.

Figure 3:
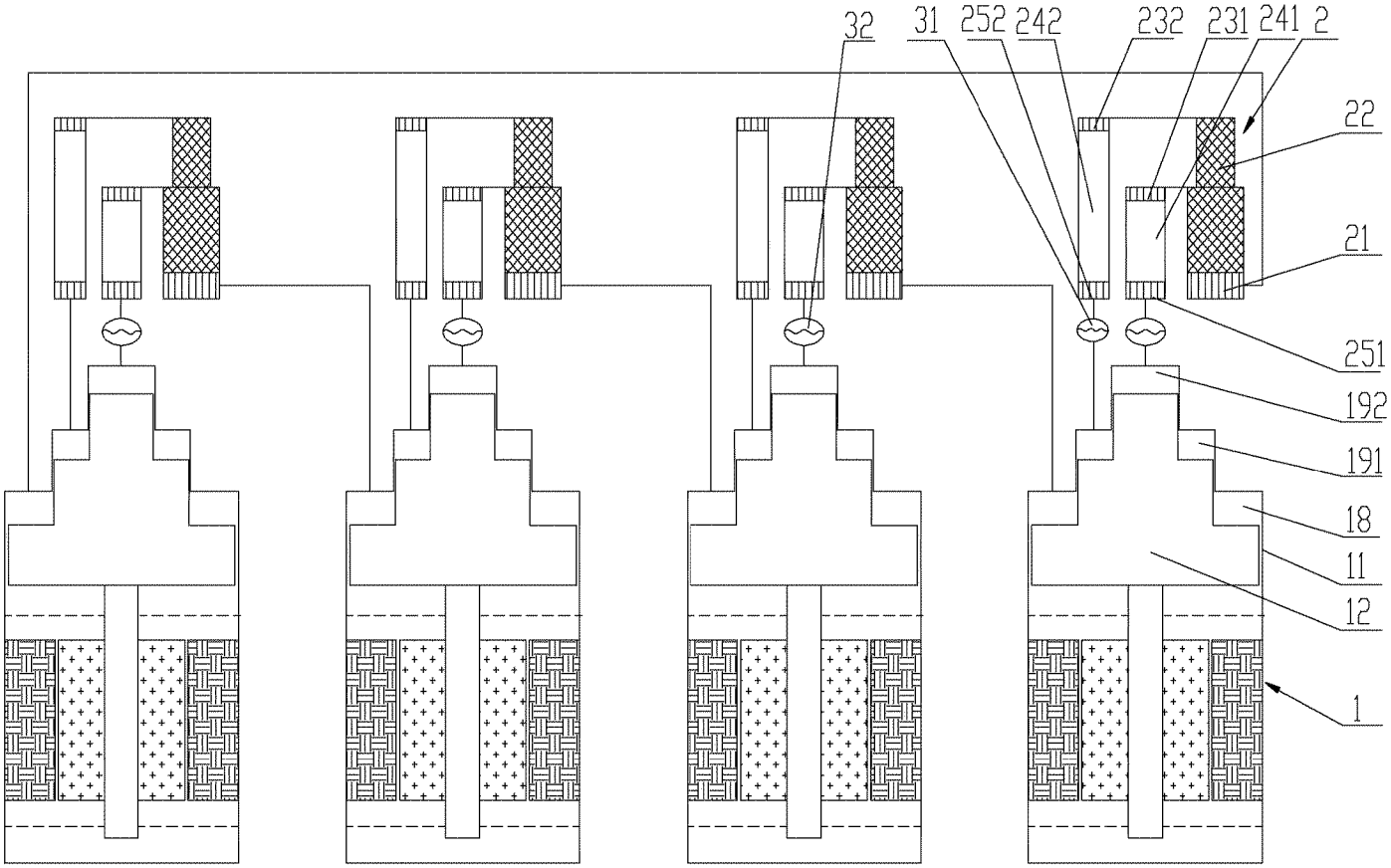
FIG. 3 is a schematic view of a multi-stage double-acting traveling-wave thermoacoustic system according to a second embodiment of the present invention.

Referring to FIG. 3, which is a schematic view of the multi-stage traveling-wave thermoacoustic system with double-acting provided in the second embodiment of the present invention.

In the second embodiment, the multi-stage traveling-wave thermoacoustic system with double-acting according to the present invention is substantially the same as the multi-stage traveling-wave thermoacoustic system with double-acting provided in the first embodiment, the difference lies in that, in the present embodiment, the multi-stage traveling-wave thermoacoustic system with double-acting includes four elementary units, and shapes of the cylinders 11 and the piston 12 are tertiary ladder structures. The cavity of the cylinder 11 includes a compression chamber 18, a first expansion chamber 191 and a second expansion chamber 192.

The compression chamber 18 is a sealed chamber formed by the first ladder of the cylinder 11 and the piston 12. In an elementary unit, the compression chamber 18 of the linear motor 1 is connected to the main heat exchanger 21 of the thermoacoustic conversion device 2 in another elementary unit.

The first expansion chamber 191 is a sealed chamber formed by the second ladder of the cylinder 11 and the piston 12. In each elementary unit, the first expansion chamber 191 is connected to the second auxiliary heat exchanger 252 of the thermoacoustic conversion device 2 in the same elementary unit, forming a loop structure for the flow of a gas medium.

The second expansion chamber 192 is a sealed chamber formed by the third ladder of the cylinder 11 and the piston 12. In each elementary unit, the second expansion chamber 192 is connected to the first auxiliary heat exchanger 251 of the thermoacoustic conversion device 2 in the same elementary unit, forming a loop structure for the flow of a gas medium.

Apparently, the multi-stage double-acting traveling-wave thermoacoustic system according to the present embodiment has the same technical effect as the multi-stage traveling-wave thermoacoustic system with double-acting in the first embodiment, which will not be repeated herein.

In addition, according to the present embodiment, two first DC suppressors 31 can be respectively mounted on the connecting pipelines of each first auxiliary heat exchanger 251 and the second expansion chamber 192. The first DC suppressor 31 can hamper DC loss caused inside the small loop between the first non-normal-temperature heat exchanger 231, the first thermal buffer tube 241 and the first auxiliary heat exchanger 251, and the second non-normal-temperature heat exchanger 232, the second thermal buffer tube 242 and the second auxiliary heat exchanger 252. Wherein a second DC suppressor 32 has been mounted between the second auxiliary heat exchanger 252 and the first expansion chamber 191. The second DC suppressor 32 can hamper DC loss caused by the large loop of the main heat exchanger 21, further improving working performance of the multi-stage double-acting traveling-wave thermoacoustic system.

The arrangement mode of the above DC suppressor is a preferable arrangement, i.e., it is possible to mount a DC suppressor on the connected pipeline of the main heat exchanger and the cylinder cavity; furthermore, a DC suppressor is mounted on the connected pipeline of at least one auxiliary heat exchanger and the cylinder cavity. The arrangement mode is also applicable to the technical solutions by other embodiments according to the present invention.

It should be noted that, in order to coordinate the phase relationship of a gas medium so as to achieve the highest working efficiency, when there are four elementary units, the directions of the working surfaces of the piston 12 can be identical or in opposite directions, that is to say, when the compassion chamber 18 in the linear motor 1 is compressed, the first expansion chamber 191 and the second expansion chamber 192 can be compressed or expanded simultaneously.

The reason is that, if the compassion chamber 18 is compressed, the first expansion chamber 191 and the second expansion chamber 192 are also compressed, and the phase difference of two ends of the thermoacoustic conversion device 2 is 90 degrees. If the compression chamber 18 is compressed, the first expansion chamber 191 and the second expansion chamber 192 are also compressed, the phase difference of volume flow between two ends of the thermoacoustic conversion device 2 is also 90 degrees, that is to say, regardless of the arrangement of the compression chamber 18 the first expansion chamber 191 and the second expansion chamber 192, the phase difference of volume flow between two ends of the thermoacoustic conversion device 2 is always 90 degrees, the working performances of the double-acting multi-stage traveling-wave thermoacoustic system are identical.

When the thermoacoustic conversion device is a thermoacoustic refrigerator, the phase difference of the current between four linear motors is 90 degrees; therefore, three-phase AC cannot be used directly as drive current, the linear motors can be driven only after the phase difference of the current being is adjusted to 90 degrees by phase device. When the thermoacoustic conversion device is a thermoacoustic engine, the phase difference of the current between four linear motors is 90 degrees; therefore, it can be switched-in to the power grid only after being phased by phase device.

Figure 4:
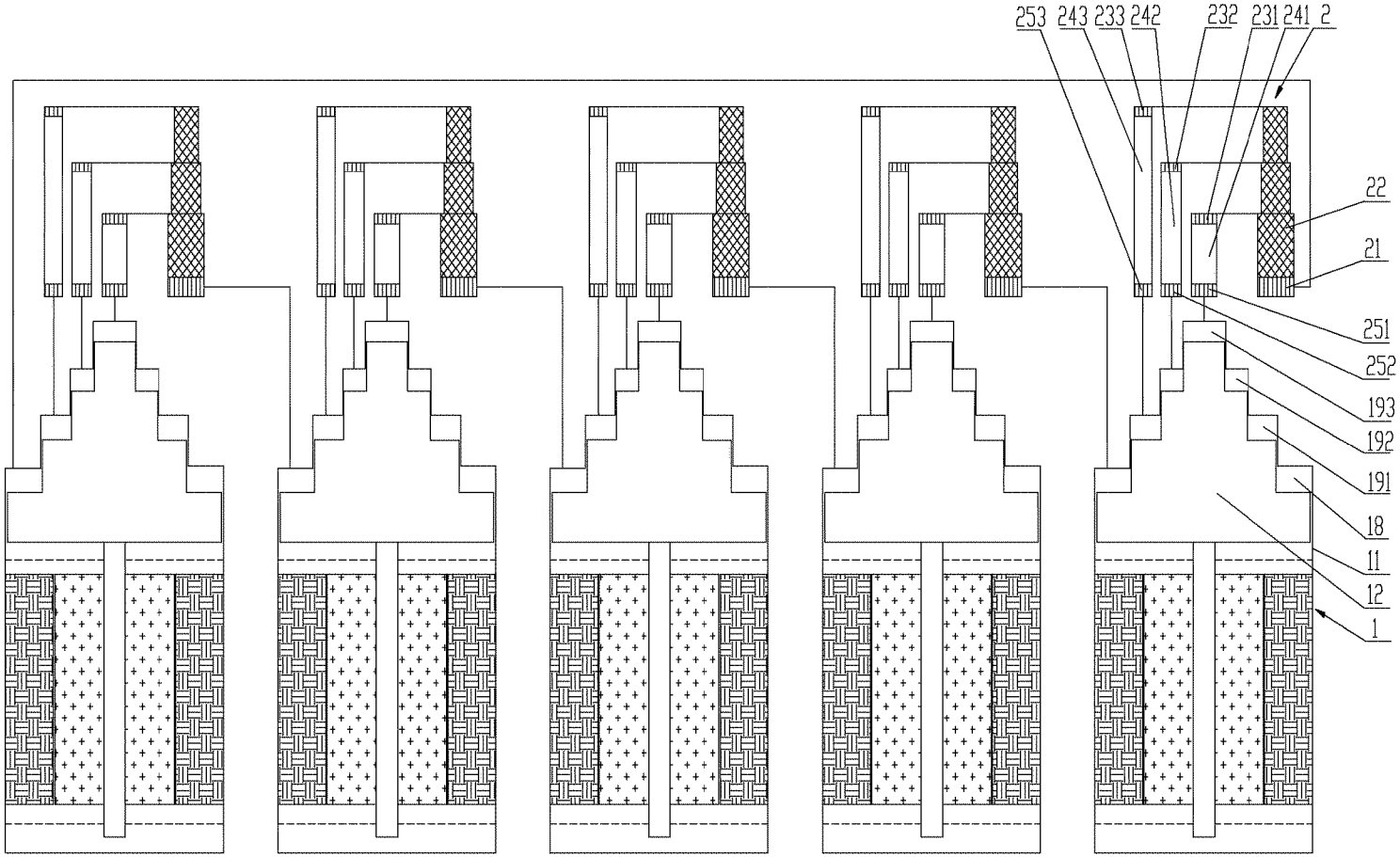
FIG. 4 is a schematic view of a multi-stage double-acting traveling-wave thermoacoustic system according to a third embodiment of the present invention.

Referring to FIG. 4, which is a schematic view of the double-acting multi-stage traveling-wave thermoacoustic system provided in the third embodiment of the present invention.

In the third embodiment, the double-acting multi-stage traveling-wave thermoacoustic system has five elementary units. The non-normal-temperature heat exchanger includes the first non-normal-temperature heat exchanger 231, the second non-normal-temperature heat exchanger 232, and the third non-normal-temperature heat exchanger 233; the auxiliary heat exchanger includes the first auxiliary heat exchanger 251, the second auxiliary heat exchanger 252, and the third auxiliary heat exchanger 253.

The heat regenerator 22 is of a tertiary ladder structure, where the first ladder of the heat regenerator 22 is connected to the first non-normal-temperature heat exchanger 231, and where the second ladder of the heat regenerator is connected to the second non-normal-temperature heat exchanger 232, and where the third ladder of the heat regenerator is connected to the third non-normal-temperature heat exchanger 233.

Shapes of the cylinder 11 and the piston 12 are quaternary ladder structures matching each other. The cavity of the cylinder 11 includes a compression chamber 18, a first expansion chamber 191, a second expansion chamber 192 and a third expansion chamber 193; the compression chamber 18 is a sealed chamber formed by the first ladder of the cylinder 11 and the piston 12. The compression chamber 18 of each linear motor 1 is connected to the main heat exchanger 21 of the thermoacoustic conversion device 2 in another elementary unit.

The first expansion chamber 191 is a sealed chamber formed by the second ladder of the piston 12 and the cylinder 11. In each elementary unit, first expansion chamber 191 is connected to the third auxiliary heat exchanger 253 of the thermoacoustic conversion device 2 in the same elementary unit, forming a loop structure for the flow of a gas medium.

The second expansion chamber 192 is a sealed chamber formed at the third ladder of the cylinder 11 and the piston 12. In each elementary unit, the second expansion chamber 192 is connected to the second auxiliary heat exchanger 252 of the thermoacoustic conversion device 2 in the same elementary unit, forming a loop structure for the flow of a gas medium.

The third expansion chamber 193 is a sealed chamber formed at the fourth ladder of the cylinder 11 and the piston 12. In each elementary unit, the third expansion chamber 193 is connected to the first auxiliary heat exchanger 251 of the thermoacoustic conversion device 2 in the same elementary unit, forming a loop structure for the flow of a gas medium.

In the present embodiment, the phase difference of volume flow between two ends of the thermoacoustic conversion device 2 is 108 degrees, which is beneficial to obtain higher conversion efficiency of the thermoacoustic energy.

It should be noted that, when there are five or more than five elementary units, i.e., the preferable mode is to guarantee the directions of the working surfaces of the pistons 12 identical, the compression chamber 18, the first expansion chamber 191, the second expansion chamber 192 and the third expansion chamber 193 must be compressed or expanded simultaneously. If one of them is compressed and the other one is expanded, the conversion efficiency of the thermoacoustic energy of the thermoacoustic conversion device 2 will be reduced.

When the thermoacoustic conversion device 2 is a thermoacoustic refrigerator, the phase difference of the current between five linear motors is 72 degrees, and the volume flow phase between the main heat exchanger 21 and the first auxiliary heat exchanger 251, the second auxiliary heat exchanger 252, and the third auxiliary heat exchanger 253 is 108 degrees. The thermoacoustic conversion device 2 can provide refrigeration quantity on three refrigeration temperatures. If the thermoacoustic conversion device 2 is a thermoacoustic engine, the phase difference of the current between five linear motors is 72 degrees. The system is capable of converting the heat with three different temperatures into output power.

Apparently, the double-acting multi-stage traveling-wave thermoacoustic system according to the present embodiment has the same technical effect as the double-acting multi-stage traveling-wave thermoacoustic system in the first embodiment. Furthermore, according to the present embodiment, because there are three complete feedback loops inside each elementary unit, it is possible to better improve the conversion efficiency of the acoustic power of the double-acting multi-stage traveling-wave thermoacoustic system, and improve working performance.

It should be noted that, the first DC suppressor 31 and the second DC suppressor 32 can both be amounted in the above three embodiments of the present invention.

Finally it should be appreciated that: the above embodiments are solely adopted to describe the technical solutions of the present invention, instead of limiting; even though elaboration has been made to the present invention in view of the aforementioned embodiments, a person skilled in the art shall understand: he or she can invariably amend the technical solutions disclosed by the aforementioned embodiments, or can equivalently replace some of the technical features thereof; nevertheless, these amendments or replacements shall not deviate the essence of the corresponding technical solutions from the spirit and scope of the technical solutions according to each embodiment of the present invention.

What is claimed is:

1. A multi-stage double-acting traveling-wave thermoacoustic system, comprising at least three elementary units, each elementary unit comprising a linear motor and a thermoacoustic conversion device, wherein the linear motor comprises a piston and a cylinder, the cylinder has a cylinder cavity, the piston can perform a straight reciprocating motion in the cylinder, wherein the thermoacoustic conversion device comprises a main heat exchanger and a heat regenerator connected in sequence, and the heat regenerator is of a ladder structure comprising at least a first regenerator portion and a second regenerator portion, wherein a step is formed between the first regenerator portion and the second regenerator portion, a set of a first non-normal-temperature heat exchanger, a first thermal buffer tube and a first auxiliary heat exchanger is connected to the first regenerator portion of the heat regenerator, and a set of a second non-normal-temperature heat exchanger, a second thermal buffer tube and a second auxiliary heat exchanger is connected to the second regenerator portion of the heat regenerator; and the main heat exchanger of each thermoacoustic conversion device is connected to a cylinder cavity of a linear motor in a different elementary unit, and the first and second auxiliary heat exchangers of each thermoacoustic conversion device are connected to cylinder cavities of the linear motor in a same elementary unit, forming a loop structure for flow of a gas medium.

2. The multi-stage double-acting traveling-wave thermoacoustic system according to claim 1, wherein a quantity of pistons is one, the cylinder is of a ladder structure comprising at least a first cylinder portion and a second cylinder portion, wherein a step is formed between the first cylinder portion and the second cylinder portion; the piston is of a ladder structure comprising at least a first piston portion and a second piston portion, wherein a step is formed between the first piston portion and the second piston portion; wherein a first cylinder cavity is formed between an upper surface of the first piston portion and an upper surface of the first cylinder portion, a second cylinder cavity is formed between an upper surface of the second piston portion and an upper surface of the second cylinder portion, and a third cylinder cavity is formed between a bottom surface of the first piston portion and a bottom surface of the first cylinder portion.

3. The multi-stage double-acting traveling-wave thermoacoustic system according to claim 1, wherein a quantity of pistons is one, the cylinder is of a ladder structure comprising at least a first cylinder portion, a second cylinder portion and a third cylinder portion, wherein a step is formed between the first cylinder portion and the second cylinder portion and a step is formed between the second cylinder portion and the third cylinder portion; the piston is of a ladder structure comprising at least a first piston portion, a second piston portion and a third piston portion, wherein a step is formed between the first piston portion and the second piston portion and a step is formed between the second piston portion and the third piston portion; wherein a first cylinder cavity is formed between an upper surface of the first piston portion and an upper surface of the first cylinder portion, a second cylinder cavity is formed between an upper surface of the second piston portion and an upper surface of the second cylinder portion, and a third cylinder cavity is formed between an upper surface of the third piston portion and an upper surface of the third cylinder portion.

4. The multi-stage double-acting traveling-wave thermoacoustic system according to claim 1, wherein the ladder structure of the heat regenerator further comprises a third regenerator portion, a step is formed between the second regenerator portion and the third regenerator portion, and a set of a third non-normal-temperature heat exchanger, a third thermal buffer tube and a third auxiliary heat exchanger is connected to the third regenerator portion of the heat regenerator.

5. The multi-stage double-acting traveling-wave thermoacoustic system according to claim 2, wherein working surfaces of the piston in each cylinder cavity are parallel, with one working surface being in the opposite direction of other working surfaces; the cylinder cavity forming an opposite working surface is connected to the main heat exchanger; and there are three or four elementary units.

6. The multi-stage double-acting traveling-wave thermoacoustic system according to claim 2, wherein working surfaces of the piston in each cylinder cavity are parallel and in a same direction, and there are four to twelve elementary units.

7. The multi-stage double-acting traveling-wave thermoacoustic system according to claim 1, wherein a direct current (DC) suppressor is mounted on a connecting pipeline between the main heat exchanger and the cylinder cavity with which the main heat exchanger is connected directly and/or on a connecting pipeline between the auxiliary heat exchanger and the cylinder cavity with which the auxiliary heat exchanger is connected directly.

8. The multi-stage double-acting traveling-wave thermoacoustic system according to claim 7, wherein a DC suppressor is mounted on a connecting pipeline between the main heat exchanger and the cylinder cavity with which the main heat exchanger is connected directly; and/or DC suppressors are mounted on at least one connecting pipeline between the auxiliary heat exchanger and the cylinder cavity with which the auxiliary heat exchanger is connected directly.

9. The multi-stage double-acting traveling-wave thermoacoustic system according to claim 8, wherein the DC suppressor is either a jet pump or an elastic diaphragm capsule.

10. The multi-stage double-acting traveling-wave thermoacoustic system according to claim 2, wherein the main heat exchanger of each thermoacoustic conversion device is connected to the third cylinder cavity in a different elementary unit, the first auxiliary heat exchanger of each thermoacoustic conversion device is connected to the second cylinder cavity in a same elementary unit, and the second auxiliary heat exchanger of each thermoacoustic conversion device is connected to the first cylinder cavity in a same elementary unit.

11. The multi-stage double-acting traveling-wave thermoacoustic system according to claim 3, wherein the main heat exchanger of each thermoacoustic conversion device is connected to the first cylinder cavity in a different elementary unit, the first auxiliary heat exchanger of each thermoacoustic conversion device is connected to the third cylinder cavity in a same elementary unit, and the second auxiliary heat exchanger of each thermoacoustic conversion device is connected to the second cylinder cavity in a same elementary unit.

12. The multi-stage double-acting traveling-wave thermoacoustic system according to claim 1, wherein a transverse dimension of the first regenerator portion is larger than a transverse dimension of the second regenerator portion.

13. The multi-stage double-acting traveling-wave thermoacoustic system according to claim 2, wherein a transverse dimension of the first cylinder portion is larger than a transverse dimension of the second cylinder portion, and a transverse dimension of the first piston portion is larger than a transverse dimension of the second piston portion.

14. The multi-stage double-acting traveling-wave thermoacoustic system according to claim 3, wherein a transverse dimension of the first cylinder portion is larger than a transverse dimension of the second cylinder portion, the transverse dimension of the second cylinder portion is larger than a transverse dimension of the third cylinder portion; and a transverse dimension of the first piston portion is larger than a transverse dimension of the second piston portion; the transverse dimension of the second piston portion is larger than a transverse dimension of the third piston portion.

* * * * *